US007014161B2

(12) United States Patent
Rampf et al.

(10) Patent No.: US 7,014,161 B2
(45) Date of Patent: Mar. 21, 2006

(54) MOULD FOR PRODUCING PRE-CAST CONCRETE UNITS

(75) Inventors: Achim Rampf, Erbach (DE); Gottfried Keller, Allmendingen (DE)

(73) Assignee: Rampf Formen GmbH, Allmendingen (DE)

( * ) Notice: Subject to any disclaimer, the term of this patent is extended or adjusted under 35 U.S.C. 154(b) by 148 days.

(21) Appl. No.: 10/472,692

(22) PCT Filed: Mar. 28, 2002

(86) PCT No.: PCT/DE02/01140

§ 371 (c)(1),
(2), (4) Date: Sep. 24, 2003

(87) PCT Pub. No.: WO02/078920

PCT Pub. Date: Oct. 10, 2002

(65) Prior Publication Data

US 2004/0104332 A1 Jun. 3, 2004

(30) Foreign Application Priority Data

Mar. 29, 2001 (DE) ..... 101 15 789

(51) Int. Cl.
*B27B 7/24* (2006.01)

(52) U.S. Cl. ..... 249/120; 249/139; 249/165; 249/168; 425/432

(58) Field of Classification Search ..... 249/120, 249/129, 139, 168, 165; 425/432
See application file for complete search history.

(56) References Cited

U.S. PATENT DOCUMENTS 6,007,321 A * 12/1999 Meckel et al. ..... 425/432
2002/0134906 A1 * 9/2002 Braungardt et al. ..... 249/132

FOREIGN PATENT DOCUMENTS

CH 424 593 A 11/1966
DE 42 42 686 C2 6/1994
DE 295 15 835 U 2/1997

OTHER PUBLICATIONS

Günter Rodon: Technischer Stand der Einbauformen für Betonsteinfertigungsautomaten. In: Betonwerk + Fertigteil-Technik, H. 2, 1979, S. 71-74.

* cited by examiner

*Primary Examiner*—Donald Heckenberg
(74) *Attorney, Agent, or Firm*—Venable LLP; Robert Kinberg

(57) ABSTRACT

A mold for producing concrete articles having a mold bottom part that includes a molded chamber block having a substantially uniform thickness and side parts attached to the molding chamber block by fasteners. The molding chamber block has molding chambers located in an inner region and cutouts located on an edge region. The cutouts form intermediate webs of approximately uniform width, and at least a portion of the cutouts are undercut slots having lateral openings. The fasteners attach the side parts to the molding chamber block via the undercut slots of the cutouts.

23 Claims, 11 Drawing Sheets

L
D
1
2
2a
2b
3
7
16
27
28
29
30
31
32
33
34
III
IV
V
VI
VII
VIII

MOULD FOR PRODUCING PRE-CAST CONCRETE UNITS

CROSS-REFERENCE TO RELATED APPLICATION

This application is a national stage application of International Application No. PCT/DE02/01140 filed on Mar. 28, 2002, which claims priority of German Application No. 101 15 789.4 filed Mar. 29, 2001.

The invention relates to a mold for the production of concrete articles.

BACKGROUND OF THE INVENTION

Such molds are employed as interchangeable molds in molding machines, known as block-making machines. They comprise a mold upper part with punches and a mold bottom part that comprises a molding chamber block and side parts, the punches fitting into chambers formed in the molding chamber block. The mold bottom part lies on a molding table, with the result that the chambers are closed at the bottom for the purpose of filling and subsequent compaction. Compaction is effected by vibrations which are transmitted from a vibrator to the concrete articles via the molding chamber block. The shaped articles formed are removed from the mold by raising the mold bottom part while keeping the position of the punches unchanged. The side parts serve for securing and guiding the molding chamber block and as rails for the charging carriage.

The prior art discloses mold bottom parts which comprise a molding chamber block and side parts screwed laterally to the latter. The molding chamber block has an inner region with molding chambers and an edge region provided to some extent with cutouts. A drawback of such mold bottom parts is the fact that they only allow limited curing since high stresses build up in the molding chamber block during the curing operation. Furthermore, extensive manufacturing steps, such as drilling and thread cutting, are required for screwing the side parts to the molding chamber block.

It has also been demonstrated by means of tests that the continued vibration of the mold after the vibrator has been switched off leads to an impairment in the quality of the surface of the concrete article in contact with the mold.

SUMMARY OF THE INVENTION

It is the object of the invention to develop a mold for the production of concrete articles which is suitable for curing and can be manufactured efficiently. Furthermore, it is the object of the invention to develop a mold for the production of improved concrete articles in which, in particular, the production process is influenced in a positive manner by means of the mold. The aim of both objects is to increase the service life of the mold and to improve the quality of the concrete articles produced with the mold.

Starting from the features of the preamble of claim 1, this object is achieved according to the invention by the characterizing features of claim 1. Advantageous and expedient developments are given in the subclaims.

The mold according to the invention for the production of concrete articles comprises a mold bottom part with a molding chamber block having a thickness or height which is substantially uniform over the length and width of the molding chamber block, the edge regions of the molding chamber block being provided with cutouts which lead to the formation of intermediate webs of approximately uniform web width, and the cutouts or the intermediate webs being used for the purpose of fastening side parts, the cutouts, as seen in plan view, being formed at least in part as an undercut slot with lateral opening to the edge region and the side parts being screwed transversely with respect to the profile of the undercut slot. As a result, an open-edge structure is formed in the edge region of the molding chamber block which counteracts the buildup of stresses or suppresses the buildup of annular stresses through the lateral openings. Furthermore, such a construction of the molding chamber block allows side parts to be fastened by means of standard components, such as screw and slot block, without requiring drilling or thread-cutting operations on the molding chamber block. The alignment of the screw connection of the side parts transversely with respect to the profile of the slot allows a high degree of loading of the side parts, since large contact areas thereof are pressed by the screw connection onto the edge region of the molding chamber block. Undercut slots are slots whose width at the base of the slot is greater than the width of the slot opening, with the result, when seen in cross section, the slot runs in a wedge-shaped, step-shaped or arc-shaped manner relative to the slot opening.

A connection with a particularly high loadbearing ability is obtained by the side parts being screwed to and/or braced with the molding chamber block via the slot and, where appropriate, by additionally welding the side part and molding chamber block.

Furthermore, it is advantageous to center the side part and the molding chamber block via pins and/or bearing surfaces. As a result, the tolerances for the screw connections or bracing connections can be selected more roughly since these are not decisive for the alignment of the side parts with the molding chamber block.

Furthermore, it is advantageous to design the cutout, which is designed in particular as a T-slot or L-slot, with a cross-sectionally angular and/or rounded cavity and a neck which opens the latter to the surround, the cavity and the neck preferably being designed as a torch-cut clearance. As a result, it is also possible to employ the torch cutting method, which is used for forming the molding chambers in the inner region of the molding chamber block, for the formation of the edge region of the molding chamber block. This means that the inner region and the edge region of the molding chamber block can be machined by the same method on a machine.

In an advantageous embodiment of the subject matter of the invention, provision is made for the slots or the cutouts to be arranged at regular intervals from one another in the edge region of the molding chamber block. This results in the formation of webs of equal width between the cutouts. Through the effect of these webs, the entire edge region demonstrates uniform behavior in respect of the curing operation. Provision is made in particular for the use of cross-sectionally T-shaped or L-shaped slots.

According to a particular embodiment of the subject matter of the invention, provision is made to design the undercut slots with different neck lengths and, in particular, to arrange slots with a different neck length next to one another in an alternating manner. Consequently, it is possible to design a wider edge region with webs of uniform width.

The use of a threaded rod with a wedge clamp as fastening means makes it possible to provide particularly rapid fastening of a side part to the molding chamber block.

By connecting the molding chamber block and the side part by means of claw-type clamping devices and/or a combination of eyebolt and wedge bolt, it is possible to connect these components particularly rapidly to one another or to release them from one another.

Provision is made according to the invention for at least one of the cutouts situated in the edge region of the mold to be filled with a damping filler. This spares the complicated operation of welding in a cover to protect the cutout from the penetration of concrete and, in particular, also avoids the occurrence of thermal distortion during welding. Furthermore, during the operation of the vibrator and after the vibrator has been switched off, a filled cutout acts on the mold in such a way that, in particular, the vibrations of the mold once the vibrator has been switched off die away quickly, and hence the formation of horizontal cracks on the side faces of the concrete articles in contact with the mold is largely avoided. Thus, the lateral surfaces of the concrete article are technically and visually improved by means of the damping.

Provision is made in particular according to the invention to use polymer concrete as the filler. Polymer concrete is substantially composed of a synthetic composition in which gravel and/or sand is embedded, for example. This material is highly suitable for the loads occurring on the mold, since it is particularly resistant to chemical and mechanical loads.

Furthermore, provision is made to configure the opening cross section of the cutout in an irregular manner or such that it deviates from a simple geometric shape. By providing narrowings and/or widenings in the cross section of the cutout, it is possible not only for the compressive loads which can be absorbed by each opening but also for tensile loads to be transmitted to the filling material. If, for example, the opening cross section of the cutout has the shape of a dog's bone, tensile stresses are transmitted in the longitudinal direction of said bone. This means that, given such a design, the filling material develops an additional effect by absorbing and damping tensile loads in at least one direction, without additional construction space being required for this purpose. This also leads in particular to greater damping of bending vibrations, since then approximately the entire filling material has a damping effect irrespective of the bending direction, since tensile and compressive loads occur simultaneously with each bending.

According to an alternative embodiment, the invention provides for walls of the cutout to be connected by means of at least one anchor having at least two anchor points. Such an interconnection of walls makes it possible to keep the mold stable even with a large number of cutouts and/or with large-volume cutouts, and to concentrate and/or channel loads and vibrations in a targeted manner by means of the anchors.

Provision is made according to the invention to fill all annularly closed cutouts with the filler. As a result, maximum damping of the vibrations present in the mold is possible.

Advantageously, the invention provides for the cutouts in the molding chamber block to be oriented in any desired spatial direction. As a result, it is possible to act on all the vibrations, or bending, tensile, compressive and torsional loads, present in the molding chamber block or to influence certain directions of vibration or loads in a targeted manner.

Furthermore, the invention provides for at least two cutouts to be connected by means of at least one connecting space and for the latter to be designed in particular as a bore. This makes it easily possible to couple the damping elements to one another or to interconnect them to form an operative assembly.

Provision is made according to the invention to fill the connecting space with filling material. This makes optimum interaction between the filled cutouts possible.

It is also provided for the cutout to be arranged in a corner region of the molding chamber block in order to prevent convergence of vibrations here.

Finally, the invention provides for an insert prefabricated from filling material to be fitted into or adhesively bonded into the cutout. This makes it possible to manufacture the insert efficiently.

BRIEF DESCRIPTION OF THE DRAWINGS

Further details of the invention are described in the drawing with reference to schematically represented exemplary embodiments. In the drawing.

DETAILED DESCRIPTION OF THE INVENTION

Figure 1:
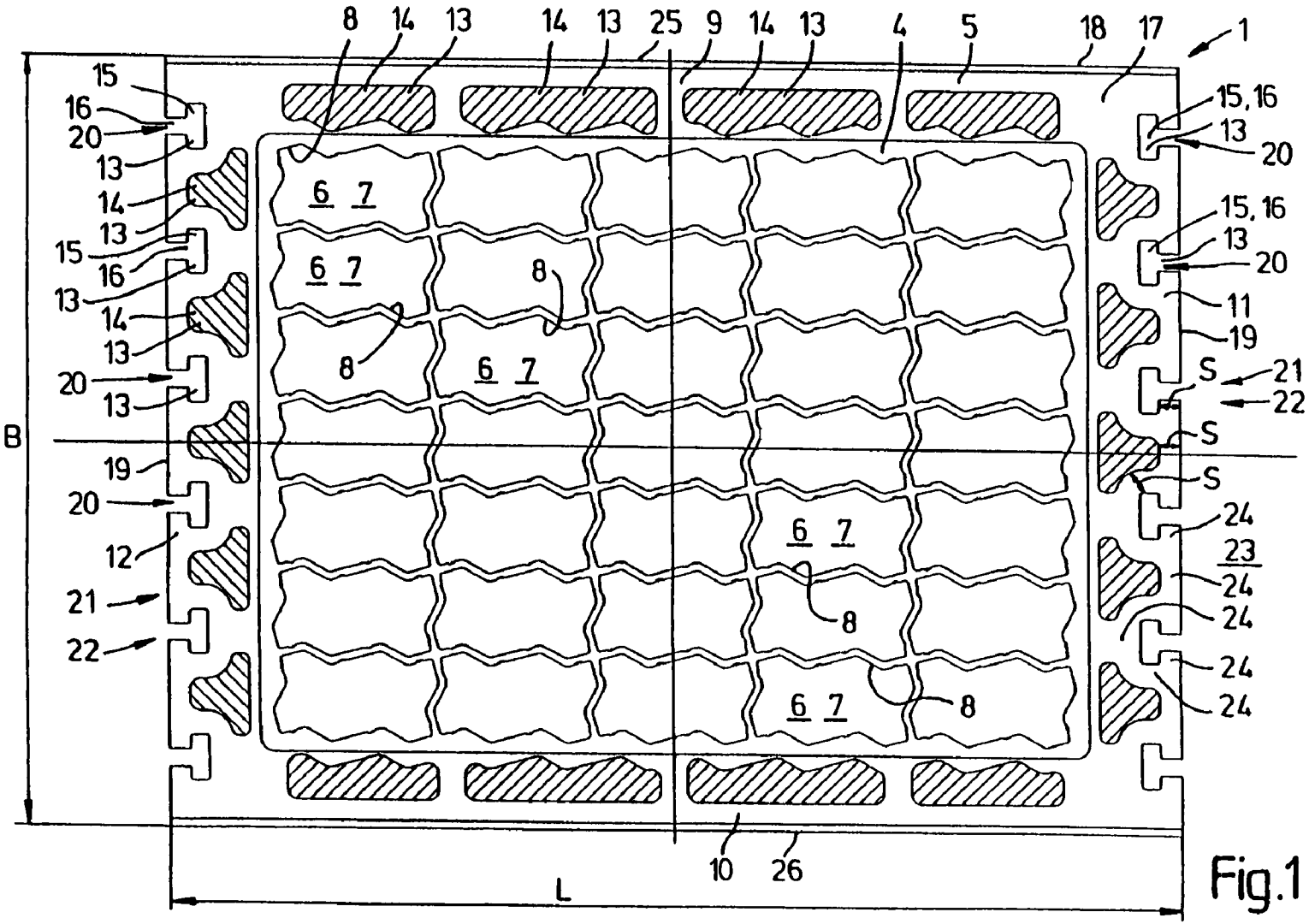
FIG. 1 shows a plan view of a molding chamber block.
Figures 2, 3:
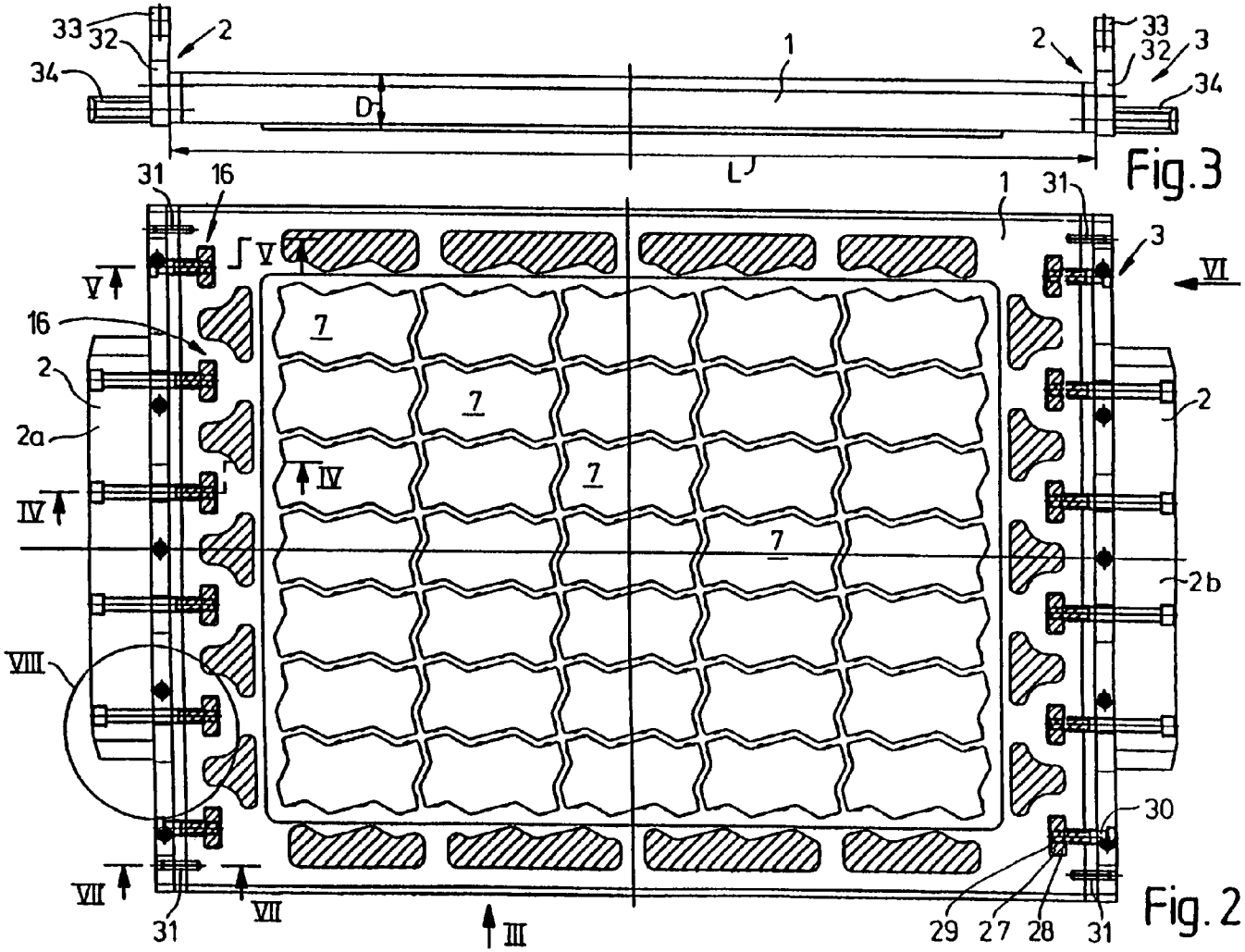
FIG. 2 shows the molding chamber block shown in FIG. 1 with screwed-on side parts.
FIG. 3 shows a side view of the mold bottom part represented in FIG. 2, from the arrow direction III.

FIG. 1 depicts a molding chamber block 1 which, together with side parts 2, forms a mold bottom part 3 (see also FIG. 2). The molding chamber block 1 has an inner region 4 and a peripheral edge region 5. Arranged within the inner region 4 are 35 cutouts or perforations 6 which serve as molding chambers 7. The molding chambers 7 pass through the molding chamber block 1 in a direction which is perpendicular to the plane of the drawing. The molding chambers 7 have a contour 8 which corresponds to the contour of concrete articles or paving blocks (not shown) which can be molded in the molding chamber block 1. The edge region 5 is composed of two opposite longitudinal edges 9, 10 and two opposite transverse edges 11, 12. The cutouts 13, which are in part closed by means of covers 14, are formed in the edge region 5 such that they run peripherally around the inner region 4. The covers 14 prevent filling material from entering the cutouts 13. Furthermore, the molding chamber block 1 has, at the transverse edges 11, 12, cutouts 13 which are designed as undercut slots 15 and extend parallel to the perforations 6. In the molding chamber block 1 shown in FIG. 1, the slots 15 are embodied as T-slots 16. The T-slots 16 run from a top side 17 to a bottom side 18 of the molding chamber block 1 and have lateral openings 20 toward transverse sides 19 of the molding chamber block 1. At the transverse edges 11, 12, toward the transverse sides 19, the slots 15 give rise to an open-edge structure 21 which, disregarding the covers 14, forms a web structure 22 in plan view. In this arrangement, the webs 24 formed between a surround 23 and slots 15 or cutouts 13 have approximately a uniform web width S. The web structure 22 extends substantially over a width B of the molding chamber block 1. According to an alternative embodiment (not shown), the molding chamber block 1 also has slots which generate an open-edge structure in the region of longitudinal sides 25, 26, in particular over a length L of the molding chamber block 1.

FIG. 2 depicts the molding chamber block 1 shown in FIG. 1, together with the screwed-on side parts 2. The molding chamber block 1 and the side parts 2 together form the mold bottom part 3 which, together with punches (not shown) that are tailored to the molding chambers 7, forms a mold for the production of shaped articles, in particular concrete articles. The side parts 2, or the left side part 2*a* and the right side part 2*b*, are screwed to the molding chamber block 1 via the T-slots 16. Arranged in the slots 16 are slot blocks 27 or nuts 28 which have a threaded bore 29 and serve as mating bearings for screws 30 (see also FIG. 8). Furthermore, the side parts 2 are connected to the molding chamber block 1 via pins 31 which serve to center the side parts 2 onto the molding chamber block 1 (see also FIG. 7).

FIG. 3 depicts a side view of the mold bottom part 3 shown in FIG. 2, from the arrow direction III. The L-shaped cross section of the side parts 2 can be seen in this view. Said side parts have a multi-part construction and comprise a connection profile 32, a wearing strip 33 placed atop said profile, and a bracket 34. In this arrangement, the wearing strip 33 is screwed to the connection profile 32 and may, where appropriate, be underlaid. Furthermore, the side view shows that the thickness D of the molding chamber block 1 is substantially uniform over the entire length L of the molding chamber block 1.

Figure 4:
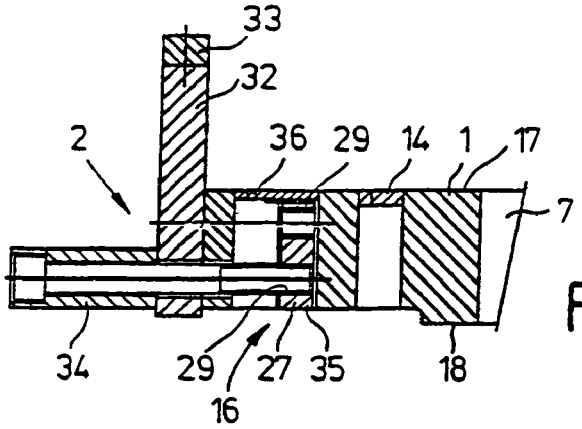
FIG. 4 shows a section through the mold bottom part represented in FIG. 2, along the section line IV—IV.

FIG. 4 shows a section through the mold bottom part 3 along the section line IV—IV depicted in FIG. 2. The slot block 27 is designed as a slot strip 35 in each case having two threaded bores 29 situated one above the other, with only the lower threaded bore 29 being used in the region of the bracket 34. In FIG. 4, just as in FIG. 2, the slot 16 is covered toward the top side 17 of the molding chamber block 1 by means of a cover 36.

Figure 5:
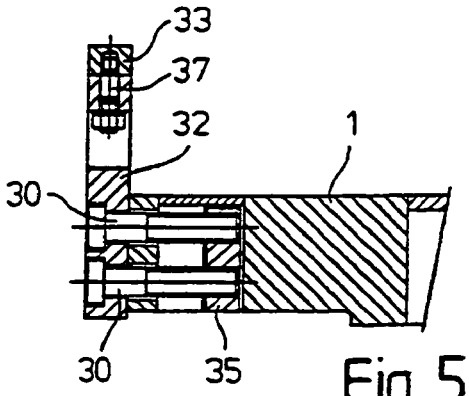
FIG. 5 shows a section through the mold bottom part represented in FIG. 2, along the section line V—V.

FIG. 5 depicts a section through the mold bottom part 3 shown in FIG. 2, along the section line V—V. This view shows a screw connection 37, which connects the wearing strip 33 to the connection profile 32. Furthermore, the screwing to the molding chamber block 1, via the slot strip 35, of the connection profile 32 by means of two screws 30 situated one above the other is shown.

Figure 6:
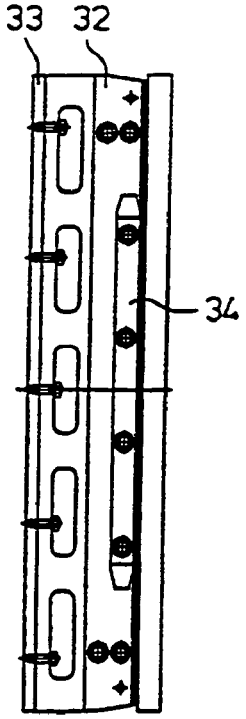
FIG. 6 shows a side view of the mold bottom part represented in FIG. 2, from the arrow direction VI.

FIG. 6 shows a side view of the mold bottom part 3 depicted in FIG. 2, from the arrow direction VI. The arrangement of the individual screw connections can be seen here.

Figure 7:
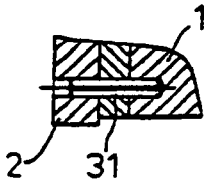
FIG. 7 shows a section through the mold bottom part represented in FIG. 2, along the section line VII—VII.
Figure 8:
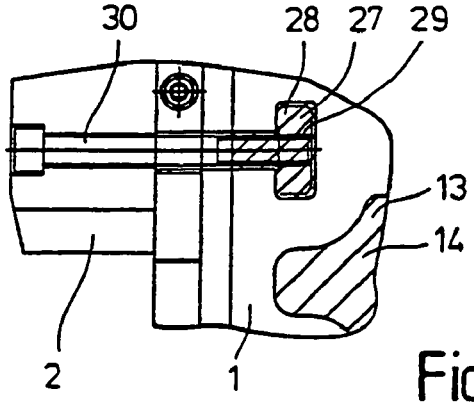
FIG. 8 shows a detail view, indicated by VIII, of the mold bottom part represented in FIG. 2.

Regarding FIGS. 7 and 8, reference is made to the description for FIG. 2.

Figure 9:
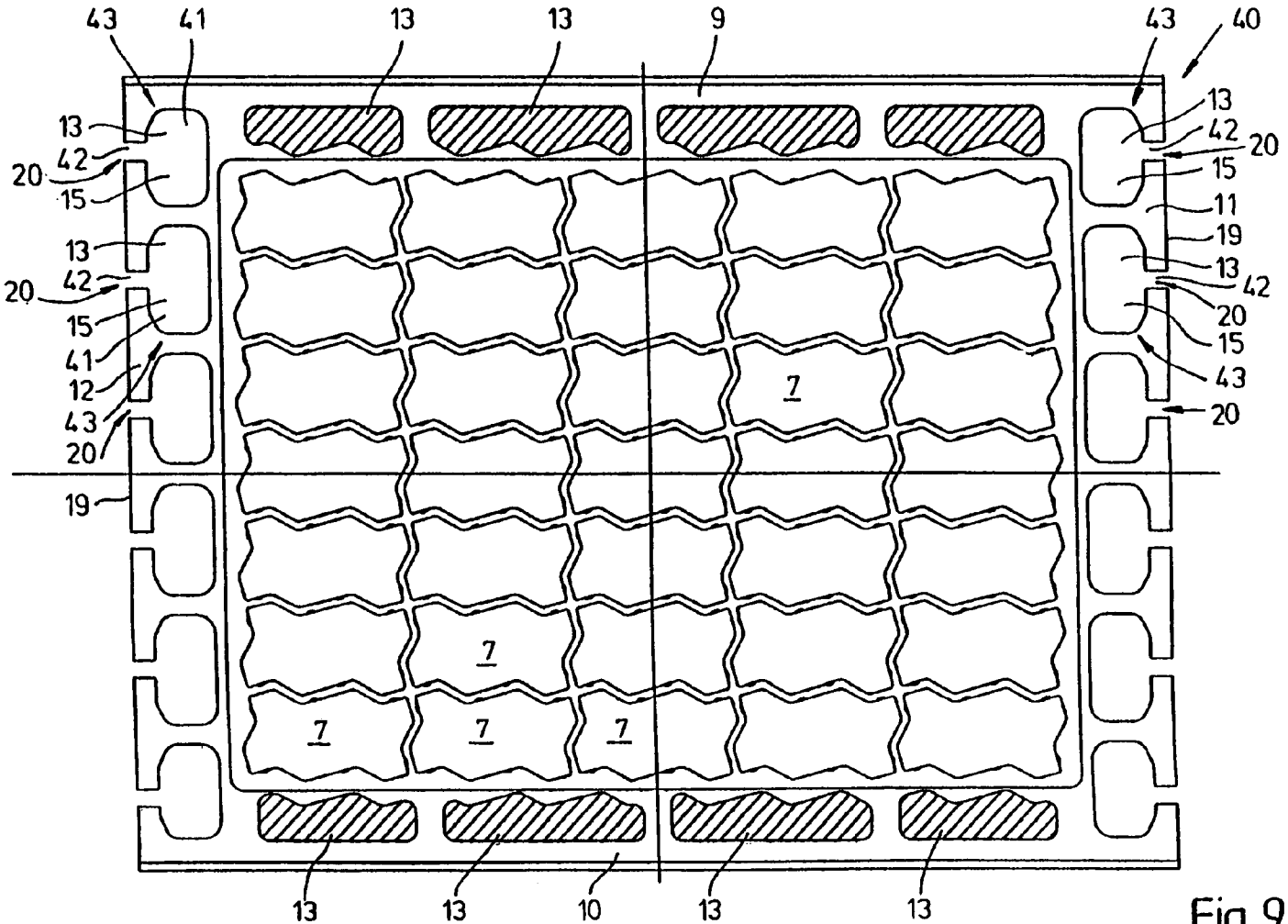
FIG. 9 shows a first variant of a molding chamber block.

FIG. 9 shows a molding chamber block 40 which has, at transverse edges 11, 12, cutouts 13 which are designed as undercut slots 15 and have lateral openings 20 toward transverse sides 19. The slots 15 possess cavities 41 which open to the transverse sides 19 via necks 42. The slots 15 are embodied as torch-cut clearances 43 which, just like cutouts 13 arranged on longitudinal edges 9, 10 and molding chambers 7, can be cut by means of a torch jet running perpendicular to the plane of the drawing.

Figure 10:
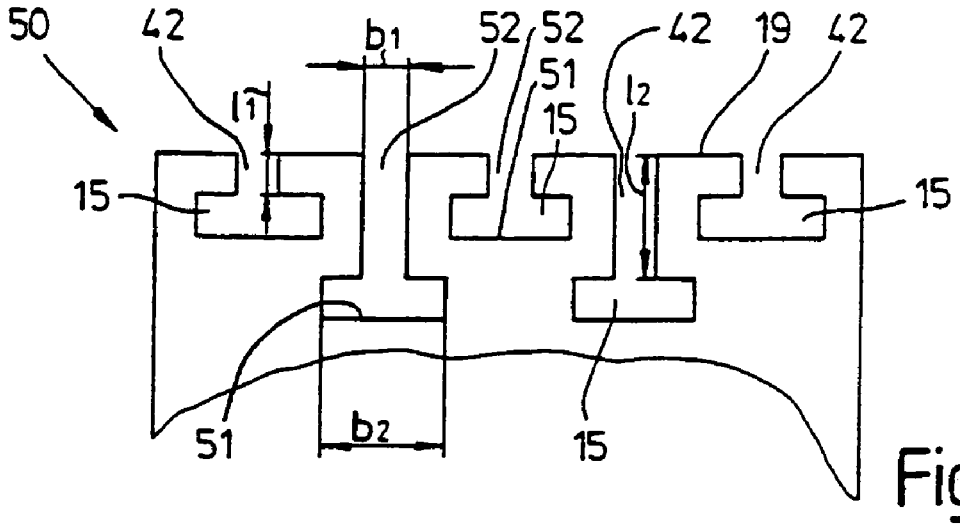
FIG. 10 shows a second variant of a molding chamber block.

FIG. 10 shows a molding chamber block 50 which has, toward a transverse side 19, undercut slots 15 which possess necks 42 with different neck lengths $l_1$ and $l_2$. Furthermore, the slots 15 possess slot bases 51 which have a width $b_2$ and slot openings 52 which have a width $b_1$.

Figure 11:
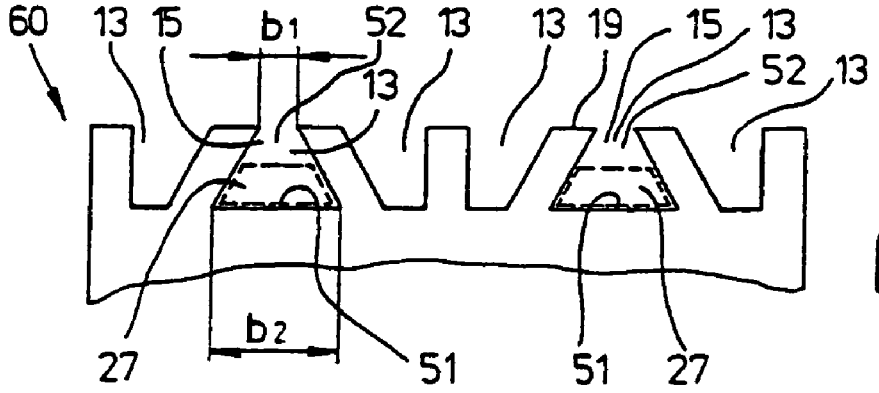
FIG. 11 shows a third variant of a molding chamber block.

FIG. 11 shows a molding chamber block 60, which, toward a transverse side 19, has cutouts 13 of which two are designed as undercut slots 15. The latter have a slot base 51 with a width $b_2$ and a slot opening 52 with a width $b_1$, $b_2$ being greater than $b_1$. The undercut slots 15 are suitable for the insertion of slot blocks 27 (shown by dashed lines) for the purpose of fastening side parts (not shown).

Figure 12:
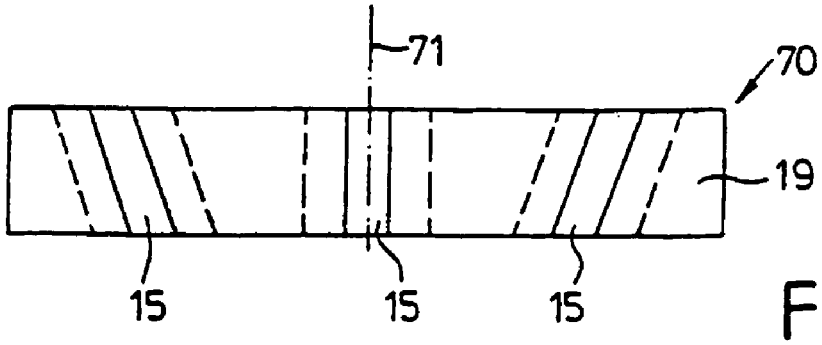
FIG. 12 shows a plan view of the transverse side of a fourth variant of a molding chamber block.

FIG. 12 shows a plan view of a transverse side 19 of a molding chamber block 70. The molding chamber block 70 has three undercut slots 15 toward the transverse side, the left and the right undercut slots 15 being arranged obliquely with respect to a perpendicular 71 and thus preventing a side part suspended therein from above sliding through if the screws have not yet been tightened.

Figure 13:
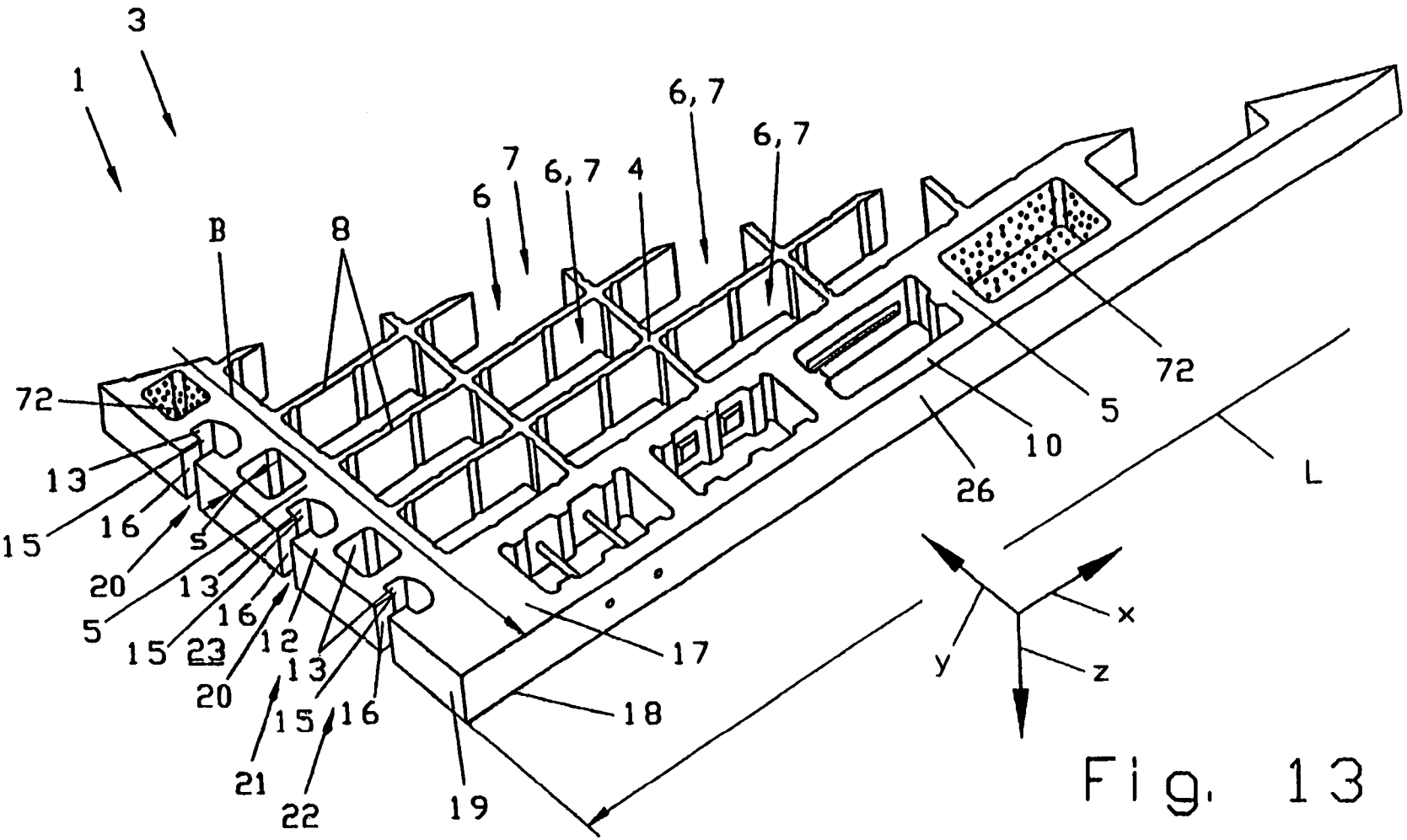
FIG. 13 shows a perspective partial view of a molding chamber block with differently designed cutouts.

FIG. 13 shows a perspective partial view of a molding chamber block 1 with differently configured cutouts 13. The molding chamber block 1 forms, together with side parts 2 (not shown), a mold bottom part 3. The molding chamber block 1 has an inner region 4 and a peripheral edge region 5. Arranged in the inner region 4 are cutouts or perforations 6 which serve as molding chambers 7. The molding chambers 7 pass through the molding chamber block 1 in a direction z which is perpendicular to the plane of the drawing. The molding chambers 7 have a contour 8 which corresponds to the contour of concrete articles or paving blocks (not shown) which can be molded in the molding chamber block 1. The edge region 5 is composed of two opposite longitudinal edges 10 (only one of the longitudinal edges is visible in FIG. 13) and two opposite transverse edges 12 (only one of the transverse edges is visible in FIG. 13). Cutouts 13 which are in part filled with polymer concrete 72 are formed in the edge region 5 such that they run peripherally around the inner region 4. On filling the perforations 6, the polymer concrete 72 prevents filling material from entering the cutouts 13 and acts in a vibration-damping maimer on the molding chamber block 1, which is excited by a vibrator (not shown). Furthermore the molding chamber block 1 has, at the transverse edges 12, cutouts 13 which are designed as undercut slots 15 and extend parallel to the perforations 6. In the molding chamber block 1 shown in FIG. 13, the slots 15 are embodied as T-slots 16. The T-slots 16 run from a top side 17 to a bottom side 18 of the molding chamber block 1 and have lateral openings 20 toward transverse sides 19 of the molding chamber block 1. At the transverse edges 11, 12, toward the transverse sides 19, the slots 15 give rise to an open-edge structure 21 which, disregarding the polymer concrete fillings, forms a web structure 22 in plan view. In this arrangement, the webs 24 formed between a surround 23 and slots 15 or cutouts 13 have approximately a uniform web width S. The web structure 22 extends substantially over a width B of the molding chamber block 1. According to an alternative embodiment (not shown), the molding chamber block 1 also has slots which generate an open-edge structure in the region of longitudinal sides 26, in particular over a length L of the molding chamber block 1.

Figure 14:
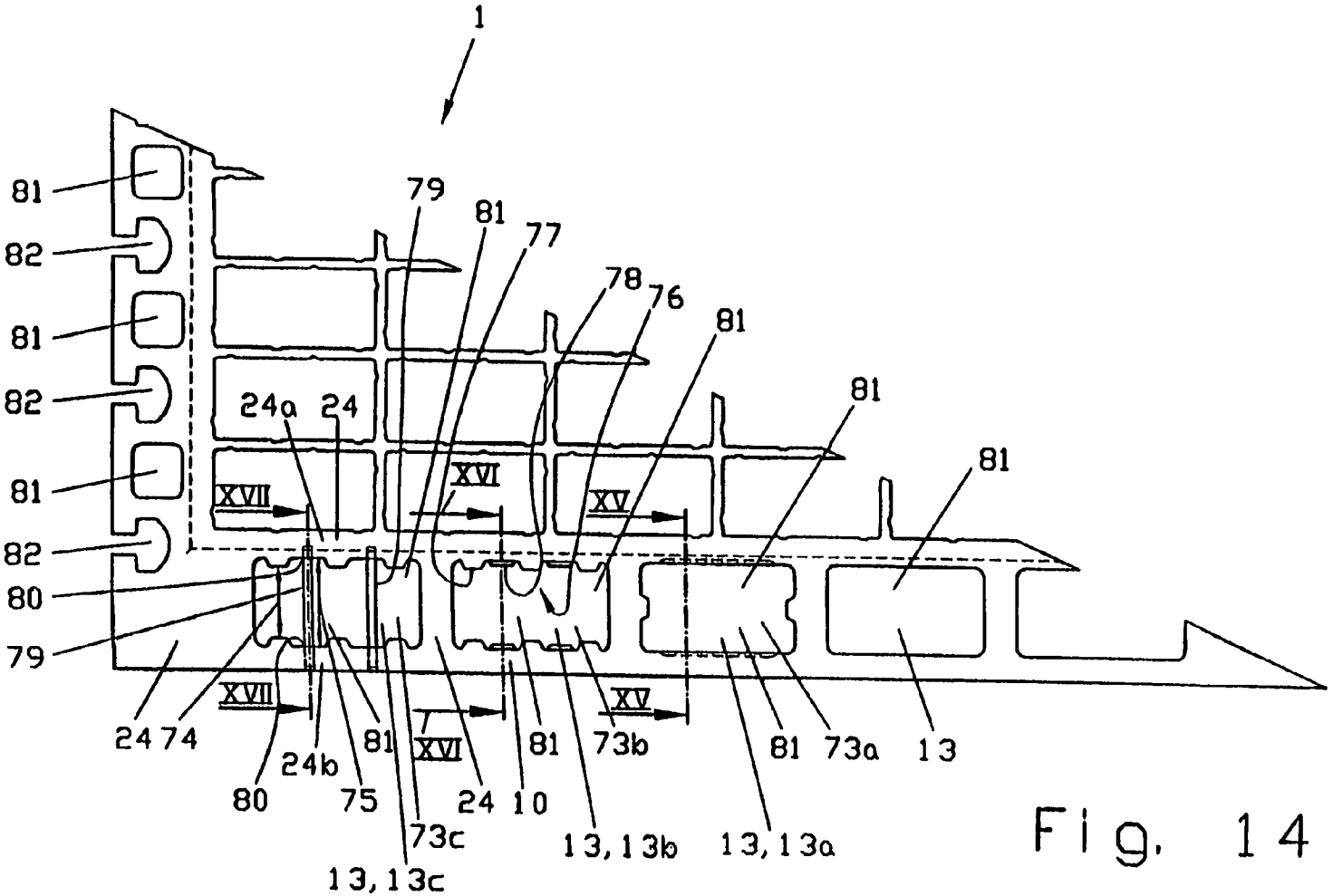
FIG. 14 shows a plan view of the molding chamber block shown in FIG. 13.

FIG. 14 shows the partial view of a plan view of the molding chamber block 1 shown in FIG. 13. In the region of a longitudinal edge 10, the molding chamber block 1 has, shown by way of exemplary representation, a large number of different cutouts 13. In this case, these are the cutouts 13*a*, 13*b*, 13*c*. These have different opening cross sections 73*a*, 73*b*, 73*c* which are characterized by narrowings 74 and widenings 75. Walls 76 have projections 77 and recesses 78. Opposite walls 76 of the cutout 13*c*, or web portions 24*a*, 24*b*, are connected by means of anchors 79, which are positively connected to the web portions 24*a*, 24*b* in anchor points 80. According to an alternative embodiment (not shown), all the annularly closed cutouts 81 are filled with polymer concrete. In order to achieve maximum vibration damping, optional provision is made for laterally open cutouts 82 (designated by 15 and 16 in FIG. 1 to 12) to be filled with polymer concrete as well after the side parts (not shown here) have been mounted.

Figure 15:
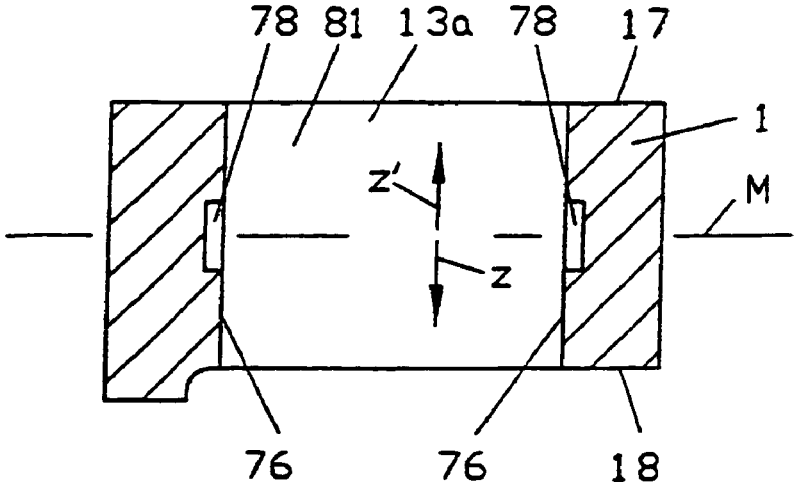
FIG. 15 shows a section through the molding chamber block represented in FIG. 14, along the section line XV—XV.

FIG. 15 shows a section in the region of the cutout 13*a* or 81 depicted in FIG. 14, along a section line XV—XV through the molding chamber block 1. The walls 76 which can be seen in the sectional view have slot-shaped recesses 78 which run parallel to the top side 17 and the bottom side 18 of the molding chamber block 1. The polymer concrete filling (not shown) which is present in the cutout 81 is held positively in the latter by virtue of the shaping of the walls 76. Consequently, acceleration forces which, during vibration, act approximately in the arrow directions z, z' on the polymer concrete filling are not transmitted solely via the adhesive bond existing between the polymer concrete and the walls 76. Vibration of the molding chamber block 1, which, for example, causes flexion of the molding chamber block 1 in the region of the cutout shown in FIG. 15, in the arrow direction z, is damped by compaction of the polymer concrete filling. In this context, the polymer concrete filling is compacted or compressed in a region situated above a central plane M.

Figure 16:
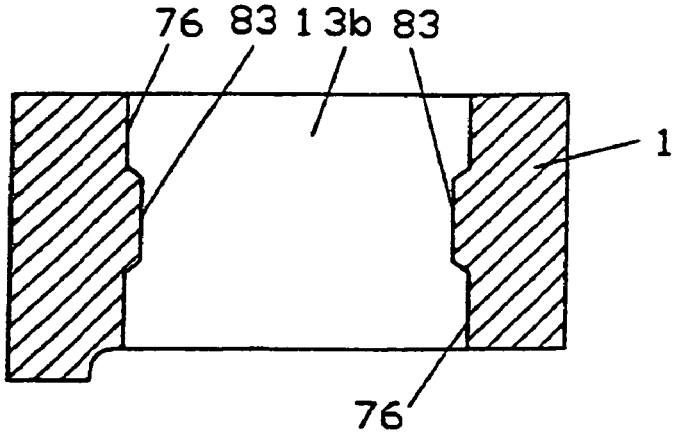
FIG. 16 shows a section through the molding chamber block represented in FIG. 14, along the section line XVI—XVI.

FIG. 16 shows a section through the molding chamber block 1 in the region of the cutout 13*b* depicted in FIG. 14, along a section line XVI—XVI. The cutout 13*b* has projections 83 in the region of recesses 78 (see FIG. 14). This makes it possible, just by way of the opposite walls 76 depicted in FIG. 16, for the polymer concrete (not shown), which fills the cutout 13*b*, to be held positively in all spatial directions x, x', y, y', z, z' (see FIG. 13).

Figure 17:
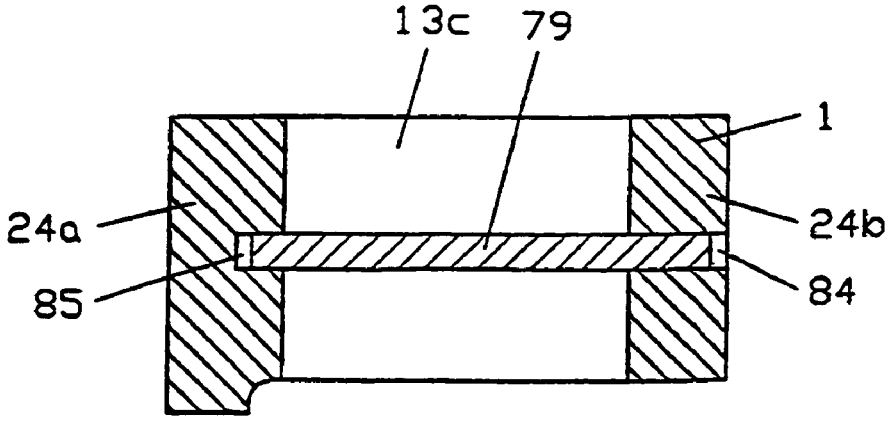
FIG. 17 shows a section through the molding chamber block represented in FIG. 14, along the section line XVII—XVII.
Figure 18C:
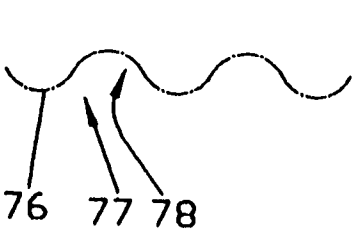
FIGS. 18*a*–18*h* shows schematically represented plan views of the cutouts.
Figure 18B:
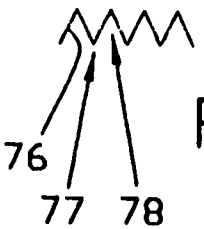
Figure 18E:
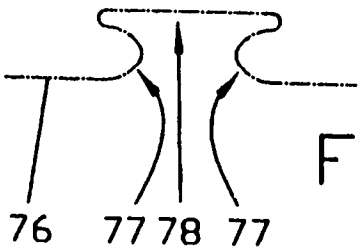
Figure 18G:
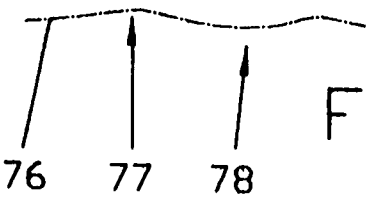
Figure 18A:
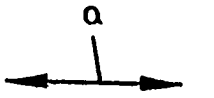
Figure 18A:
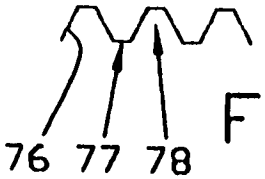
Figure 18D:
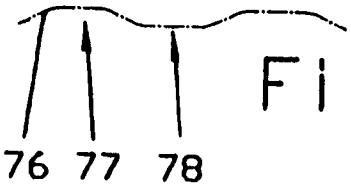
Figure 18F:
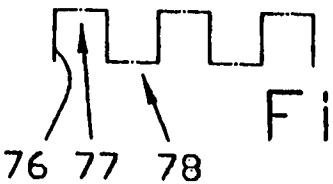
Figure 18H:
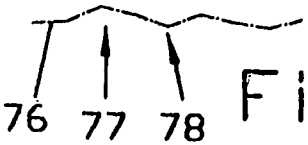

FIG. 17 shows a section through the molding chamber block 1 in the region of the cutout 13*c* depicted in FIG. 14, along a section line XVII—XVII. The anchor 79 is screwed into the web portions 24*a*, 24*b*, said anchor being held in a through thread 84 in the web portion 24*b* and in a blind hole thread 85 in the web portion 24*a*. The anchor serves as a tension and compression bar for stabilizing the molding chamber block 1. For vibration damping and to reduce weight, the anchor 79 makes it possible to make available large cutouts 13*c* without having to dispense with the stability of the molding chamber block 1. Vibrations of the anchor 79 are damped by means of polymer concrete (not shown) surrounding said anchor.

FIGS. 18*a* to 18*h* show schematically represented plan views of walls 76 which delimit cutouts. A common feature of all the wall profiles is that they have projections 77 and recesses 78 which lead to positive meshing of the polymer concrete with the molding chamber block. This makes it possible for tensile stresses acting in the longitudinal direction a of the wall 76 to be damped in a targeted manner via the polymer concrete, since the stresses are transmitted directly to said concrete from the walls 76.

Figure 19:
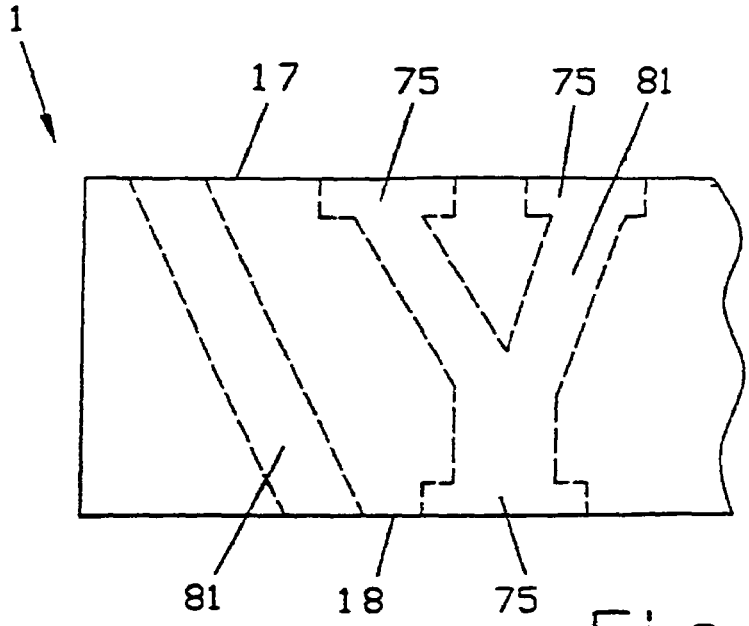
FIG. 19 shows a side view of a further molding chamber block with oblique cutouts.

FIG. 19 shows a side view of a further molding chamber block 1 with oblique cutouts 81. The left cutout 81 runs diagonally from a bottom side 18 to a top side 17 of the molding chamber block 1. The right cutout 81 is designed to be approximately Y-shaped in cross section and has, toward the bottom side 18 and toward the top side 17 of the molding chamber block 1, widenings 75 by means of which positive fixing of the polymer concrete filling (not shown) is achieved.

Figure 20:
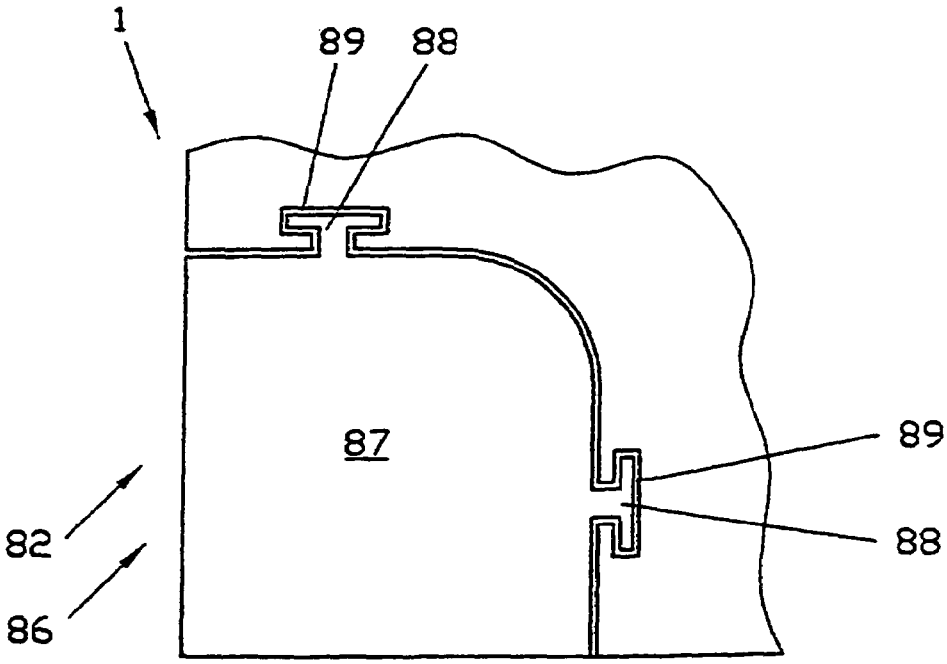
FIG. 20 shows a plan view of a further molding chamber block.

FIG. 20 shows a plan view of a further molding chamber block 1. In a corner region 86, the molding chamber block 1 has a laterally open cutout 82 into which a polymer concrete element 87 has been inserted. The latter is provided for damping vibrations which converge in the corner region 86 and is held positively on the molding chamber block 1 via lugs 88 which engage in slots 89 of the molding chamber block 1.

Figure 21:
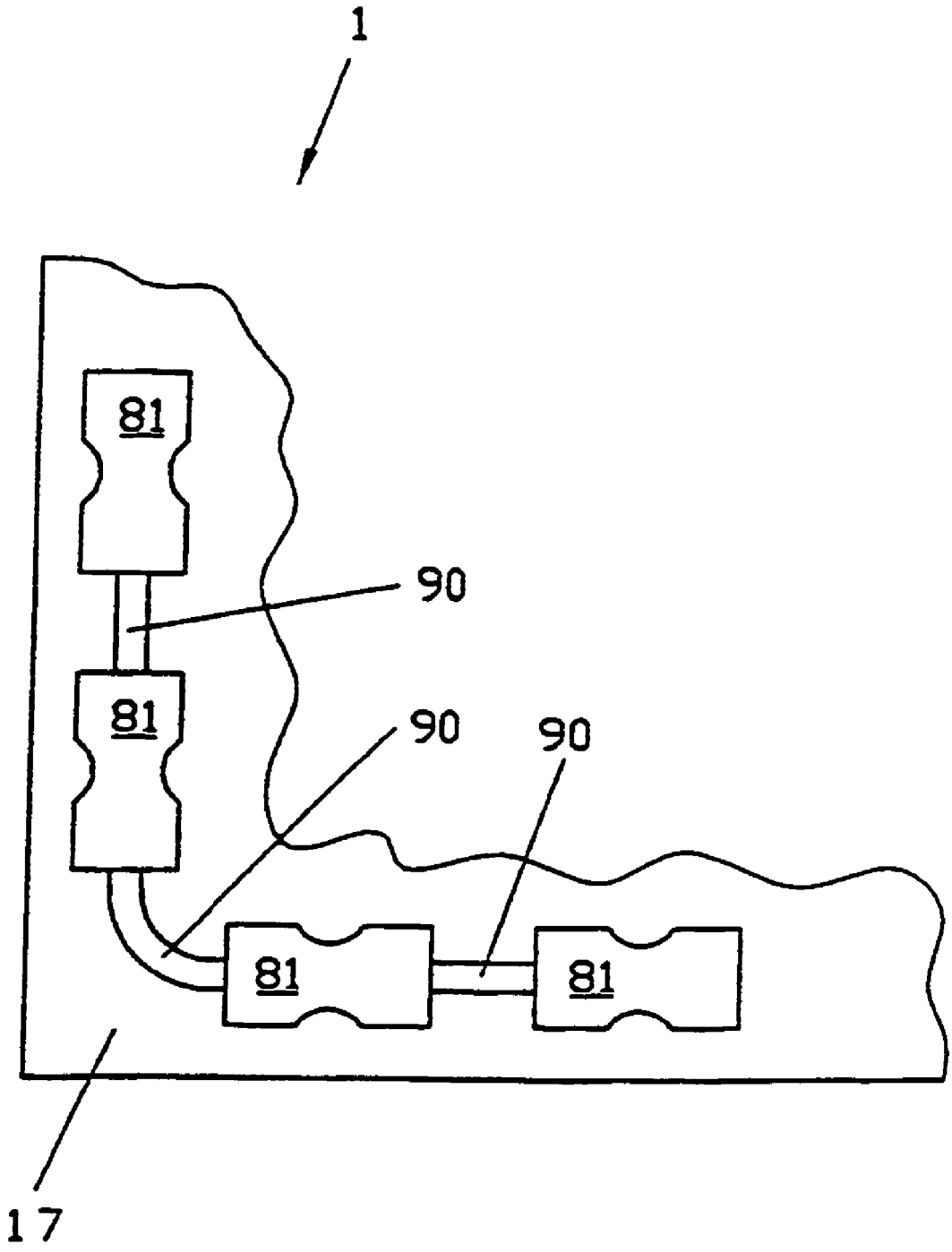
FIG. 21 shows a plan view of a further molding chamber block with connecting spaces between the cutouts.

FIG. 21 is a schematic representation of a detail of a further molding chamber block 1. The molding chamber block 1 has cutouts 81 which are connected by means of connecting spaces 90 that are open toward a top side 17 of the molding chamber block 1. Like the cutouts 81, the connecting spaces 90 are filled with polymer concrete.

The invention is not restricted to exemplary embodiments which have been represented or described. Rather, it encompasses developments of the invention within the scope of the patent claims. In particular, the invention also provides for the use of cutouts and slots with rounded corners and edges. The filling of cutouts with polymer concrete is intended both for screwed-together and for welded-together mold bottom parts, also referred to as the mold in some cases.

What is claimed is:

1. A mold for producing concrete articles comprising a mold bottom part, said mold bottom part including:

a molding chamber block having a substantially uniform thickness, said molding chamber block having an inner region including molding chambers and an edge region including cutouts, said cutouts defining intermediate webs of approximately uniform width, at least a portion of said cutouts comprising undercut slots having lateral openings;

at least one fastener; and side parts attached to said molding chamber block by said at least one fastener extending through a respective said lateral opening.

2. The mold as claimed in claim 1, wherein said at least one fastener comprises at least one of screws and braces, through which said side parts are attached to said molding chamber block via said undercut slots.

3. The mold as claimed in claim 2, wherein said side parts are additionally welded to said molding chamber block via said undercut slots.

4. The mold as claimed in claim 1, further comprising at least one of pins and bearing surfaces that align said side parts and said molding chamber block with one another.

5. The mold as claimed in claim 1, wherein said cutouts are arranged at regular intervals.

6. The mold as claimed in claim 1, wherein said undercut slots are at least one of T-slots and L-slots, and said T-slots and L-slots have in cross section an angular or rounded cavity and a neck.

7. The mold as claimed in claim 6, wherein said undercut slots are torch-cut clearances.

8. The mold as claimed in claim 6, wherein said undercut slots have different neck lengths and are arranged next to one another in an alternating manner.

9. The mold as claimed in claim 1, wherein said at least one fastener is a threaded rod with a wedge clamp.

10. The mold as claimed in claim 1, wherein said at least one fastener is a step-shaped, dowel, claw, clamping device.

11. The mold as claimed in claim 1, wherein said at least one fastener is an eyebolt with a wedge bolt.

12. The mold as claimed in claim 1, further comprising a damping filler that fills said cutouts.

13. The mold as claimed in claim 12, wherein said filler is polymer concrete.

14. The mold as claimed in claim 1, wherein said cutouts have an opening cross section with narrowing portions and widenings portions.

15. The mold as claimed in claim 1, further comprising at least one anchor having at least two anchor points that connects walls of said cutouts.

16. The mold as claimed in claim 12, wherein a portion of said cutouts are annularly closed, and said annularly closed cutouts are filled with said damping filler.

17. The mold as claimed in claim 1, wherein said cutouts run through said molding chamber block in any spatial direction.

18. The mold as claimed in claim 1, wherein at least two cutouts are connected by at least one connecting space.

19. The mold as claimed in claim 18, wherein said connecting space is a bore.

20. The mold as claimed in claim 18, further comprising filling material filled in said connecting space.

21. The mold as claimed in claim 1, wherein said cutouts are arranged in a corner region of said molding chamber block.

22. The mold as claimed in claim 1, further comprising a prefabricated insert composed of filling material disposed in said cutouts.

23. A mold bottom part for producing concrete articles, comprising:

a molding chamber block having a substantially uniform thickness including:

a plurality of molding chambers located in an inner region thereof, said chambers extending in the thickness direction;

an edge region, surrounding said molding chambers, having a plurality of cutouts in the periphery thereof to form a web of uniform width, a portion of said cutouts extending in said thickness direction and forming undercut slots with lateral openings perpendicular to said thickness direction in said edge region; and side parts attached to said edge region by screws inserted therein and into the lateral openings in said undercut slots.

* * * * *